US010427856B2

(12) United States Patent
Salazar

(10) Patent No.: US 10,427,856 B2
(45) Date of Patent: Oct. 1, 2019

(54) METHOD OF CREATING AND MAINTAINING A VACUUM IN A STORAGE BAG

(71) Applicant: Dennis R. Salazar, Albuquerque, NM (US)

(72) Inventor: Dennis R. Salazar, Albuquerque, NM (US)

( * ) Notice: Subject to any disclaimer, the term of this patent is extended or adjusted under 35 U.S.C. 154(b) by 0 days.

(21) Appl. No.: 15/636,558

(22) Filed: Sep. 18, 2017

(65) Prior Publication Data

US 2018/0319564 A1 Nov. 8, 2018

Related U.S. Application Data

(62) Division of application No. 14/872,397, filed on Oct. 1, 2015, now abandoned.

(51) Int. Cl.

| | |
|---|---|
| ***B65D 33/00*** | (2006.01) |
| ***B65D 81/20*** | (2006.01) |
| ***B65D 33/18*** | (2006.01) |
| ***B65D 33/25*** | (2006.01) |

(52) U.S. Cl.

CPC ..... *B65D 81/2023* (2013.01); *B65D 33/18* (2013.01); *B65D 33/2508* (2013.01); *B65D 81/2038* (2013.01)

(58) Field of Classification Search

CPC ..... B65D 33/00; B65D 33/01; B65D 33/14; B65D 33/16

USPC ..... 53/432, 434; 206/213.1, 524.8

See application file for complete search history.

(56) References Cited

U.S. PATENT DOCUMENTS

| | | | | |
|---|---|---|---|---|
| 3,133,696 | A * | 5/1964 | Mirando | A47C 27/081 137/846 |
| 4,211,267 | A * | 7/1980 | Skovgaard | B65D 33/00 229/69 |
| 5,129,519 | A * | 7/1992 | David | B65D 81/1075 206/523 |
| 6,168,019 | B1 * | 1/2001 | Olson | A41D 19/0075 206/278 |
| 2002/0009240 | A1 * | 1/2002 | Anderson | B65D 33/01 383/100 |
| 2004/0000503 | A1 * | 1/2004 | Shah | B65D 33/01 206/524.8 |
| 2006/0182371 | A1 * | 8/2006 | Borchardt | B65D 81/2023 383/44 |
| 2007/0221532 | A1 * | 9/2007 | DiLiberto | B65B 63/02 206/524.8 |

(Continued)

*Primary Examiner* — Chelsea E Stinson

(57) ABSTRACT

A method for creating a vacuum in a storage bag can be used to create a vacuum without the use of an external vacuum source. The vacuum storage bag has a resilient sponge compressible polymeric material mass such as a sheet of sufficient thickness that is an integral part of an internal wall of a storage bag. A vacuum can be produced by compressing the sponge within this sealable bag. When the sponge is an integral part of the internal bag wall, it will not shift nor interfere with a valve or bag closure. A vacuum may be created by compressing the resilient sponge material along with a food product, dry goods, or any other material that is to be stored. This results in forcing the air volume out of the sealable bag. Any residual air not exhausted from bag will be trapped within sponge material when sponge expands.

12 Claims, 4 Drawing Sheets

(56) References Cited

U.S. PATENT DOCUMENTS

| | | | | |
|---|---|---|---|---|
| 2010/0005973 | A1* | 1/2010 | Doglioni Majer ..... | B65D 75/38<br>99/295 |
| 2011/0120899 | A1* | 5/2011 | Sorensen ..... | B65D 81/03<br>206/522 |

* cited by examiner

METHOD OF CREATING AND MAINTAINING A VACUUM IN A STORAGE BAG

BACKGROUND OF THE INVENTION

1. Field of the Invention

The present invention relates to an extremely simple and economical vacuum storage bag which does not require the use of an external vacuum source. This simple system can replace many off-the-shelf freezer and storage bags such as Ziploc, Glad, Hefty and independent freezer and standard storage bags as well as those by The FoodSaver, Weston or Nesco vacuum appliances and other similar units. It is much more economical and more likely to be purchased by everyday shoppers without investing in expensive vacuum equipment and specialized vacuum bags needed to use such equipment. The new invention discloses a resilient compressible polymeric material that may be an integral part of one of the bag walls or an insert of a resilient compressible polymeric material.

2. Description of the Prior Art

There are presently a wide variety of bags and storage systems in which food and other materials can be stored indefinitely. Many of the existing bags and systems provide a means of removing air from the storage areas of the bag to prevent spoilage or degradation of the contents. The distinction between the bag of the present invention and other vacuum storage bags is that most of the prior art requires the purchase of an external vacuum machine in combination with expensive ribbed or embossed poly sheet material manufactured into the storage bag to allow air to flow past the embossed pattern before sealing contents with a hot sealer after air is evacuated from bag.

U.S. Pat. No. 6,883,665 discloses an apparatus and method of manufacturing a poly bag with interposed embossed ribbed sheet inserted into bag to allow passage for gasses to be evacuated from storage bag by a vacuum machine and combination hot sealer. Expensive and cumbersome appliances along with costly vacuum bags are what make this patent insufficient as an answer when an economical and simple bag system is desired. The innovative, simple and inexpensive bag system of the present invention accomplishes this. It should be mentioned that other companies have manufactured a bag that is ribbed and or embossed on one wall of bag and is used with these expensive machines. Those bags are also very costly and not available in many local stores, even if you own the vacuum/hot sealer.

U.S. Pat. No. 6,550,966 discloses a bag assembly that is a double bagged system to isolate the contents with a double walled poly film and with a combination of valves to remove air from both outer bag and inner bag. This prior art is very difficult to make and isn't very practical or cost effective and hasn't been seen as a large seller in the market.

U.S. Pat. No. 6,231,236 discloses a resealable food bag with a one way valve but still doesn't resolve the problem of air left in bag. As quoted from the patent, "at least partial exhaustion of gases is desirable." Because this prior art does not offer a means of removing air from the storage area, it does not eliminate freezer burn for sensitive food products.

There hasn't been much progress to address the compression method of storing perishable food products and several prior art references have been dedicated to addressing storage of clothing, blankets and pillows. It shows that it hasn't been obvious to use an inert resilient compressible vacuum-producing polymer to co-exist with a food product or any other object inside of a storage bag. This new invention introduces an inert polymeric compressible resilient member to a storage bag assembly. The storage bag now becomes a vacuum food storage container by simply compressing or rolling the bag then releasing, thereby producing a vacuum and pushing the air out of the bag through a valve, be it a valved zipper slide assembly or circular valve aperture attached to a wall of the bag. The system of the present invention may also be used to store sensitive materials such as medical substances or sensitive dry goods that may or may not need to be frozen.

SUMMARY OF THE INVENTION

The present invention is an extremely simple and economical vacuum storage bag which does not require the use of an external vacuum source. With the addition of a resilient sponge sheet or a resilient compressible polymeric material mass such as a cylinder or rectangular block or any shape of sufficient thickness inserted into the bag, a vacuum can be produced within this sealable bag. The sponge can also be an integral part of inner bag that allows displacement of air inside the bag along with the desirable food product/dry goods or any other material that is to be stored. By compressing the resilient sponge material/resilient mass by flattening or rolling contents along with, for example, a food product/medical substance/dry goods and forcing the air volume out of the sealed storage bag, utilizing one of the many valved zipper closures or pinch rail valve closure systems expelling the air. There will be sufficient vacuum as resilient sponge or mass has displaced essentially, most of the volume of air in the bag, and will return to its original larger dimension, thereby producing a vacuum. If possible, a food/dry goods product, if not yet frozen, may also allow the bag with sponge and food product to be pressed and/or rolled, also accomplishing the compression of the sponge and food in the sealed bag, and released, returning the sponge to its original shape, thereby producing a vacuum. Also, dry goods that are often stored in the pantry may benefit from the same vacuum storage bag and consumer can always open a bag and take out dry goods such as nuts, and restore vacuum within the bag, keeping contents dry and fresh.

It is a primary object of the present invention to provide a simple and economical storage bag and method for storing goods outside the presence of air without the use of expensive vacuum equipment.

It is another object of the present invention to provide a simple and economical storage bag and method for storing goods outside the presence of air that is convenient and affordable.

It is a further object of the present invention to provide a simple and economical storage bag and method for storing goods outside the presence of air that can be either reusable or disposable.

These and other objects of the present invention will become apparent to those skilled in the art upon reading the accompanying description, drawings, and claims set forth herein. The headings provided are for the convenience of the reader only. No headings should be construed to limit the content in any way.

BRIEF DESCRIPTION OF THE DRAWINGS

The benefits of the present invention are evident from the subsequent description, the included claims, and the attached drawings wherein:

DETAILED DESCRIPTION OF THE INVENTION

1. Definitions

Figure 1:
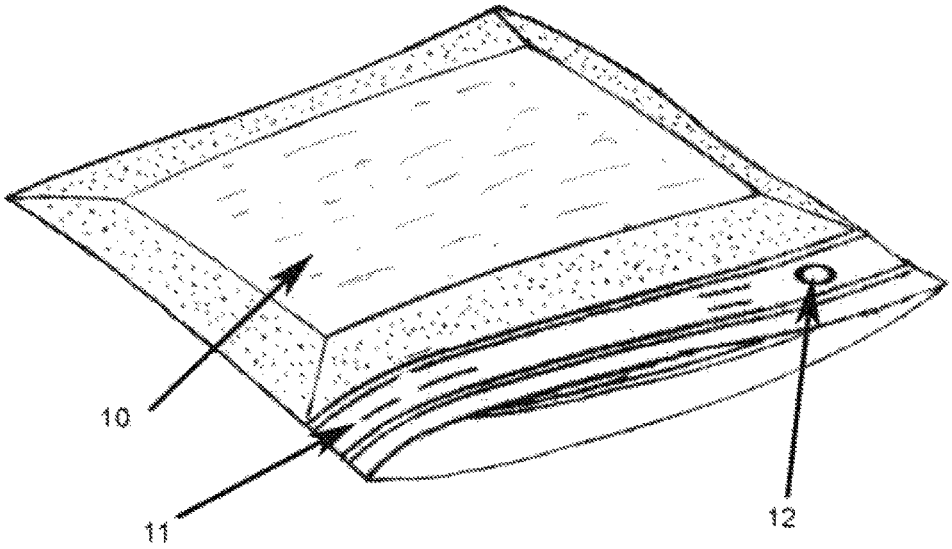
FIG. 1 is a perspective view of the polymeric bag and sponge material combination with a one-way valve.
Figure 2:
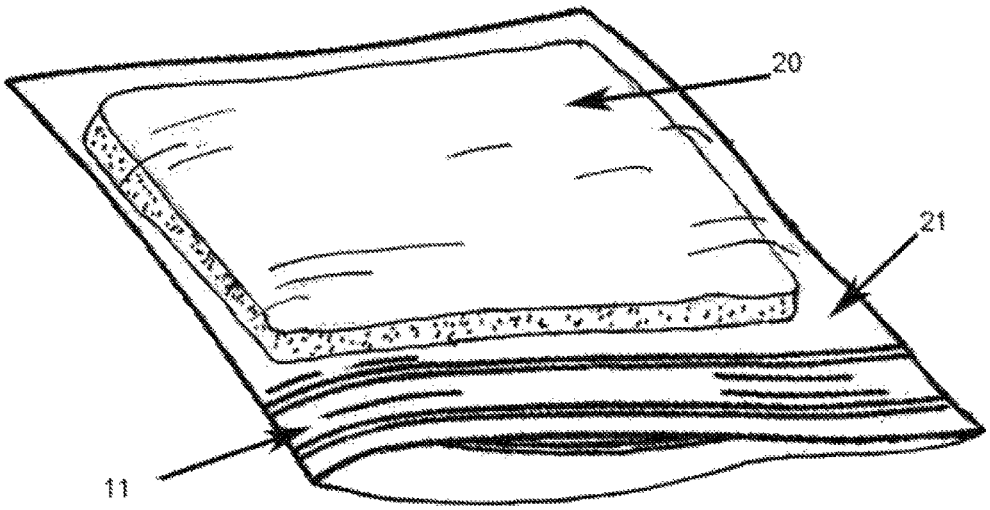
FIG. 2 is a perspective view of the polymeric bag and sponge material combination.
Figure 3:
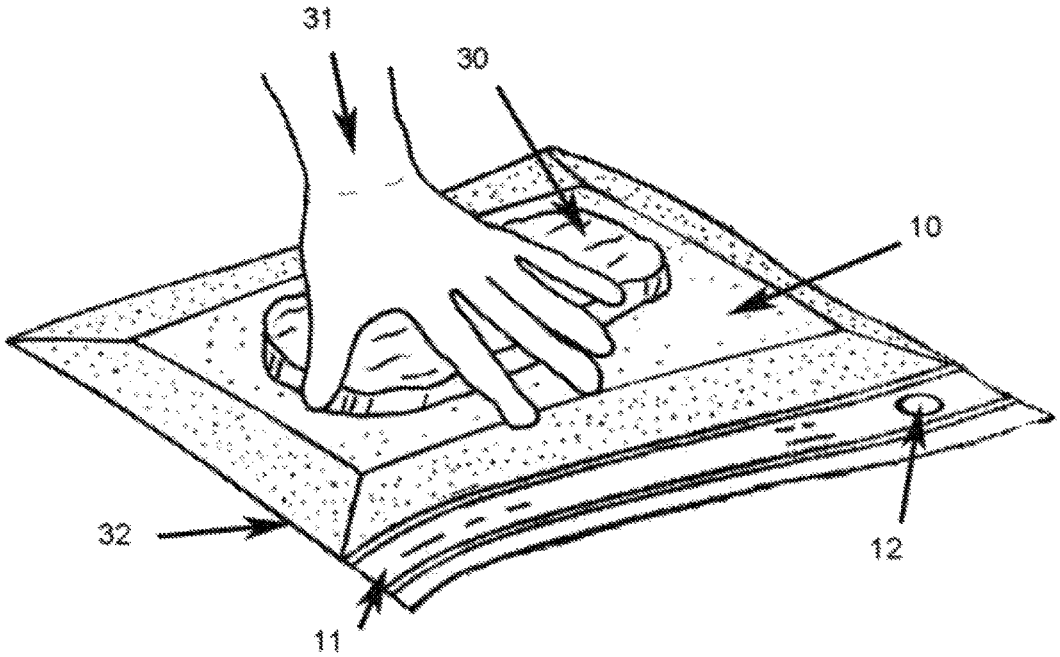
FIG. 3 is a perspective view of the polymeric bag and sponge material combination with a one-way-valve containing an item to be stored.
Figure 4:
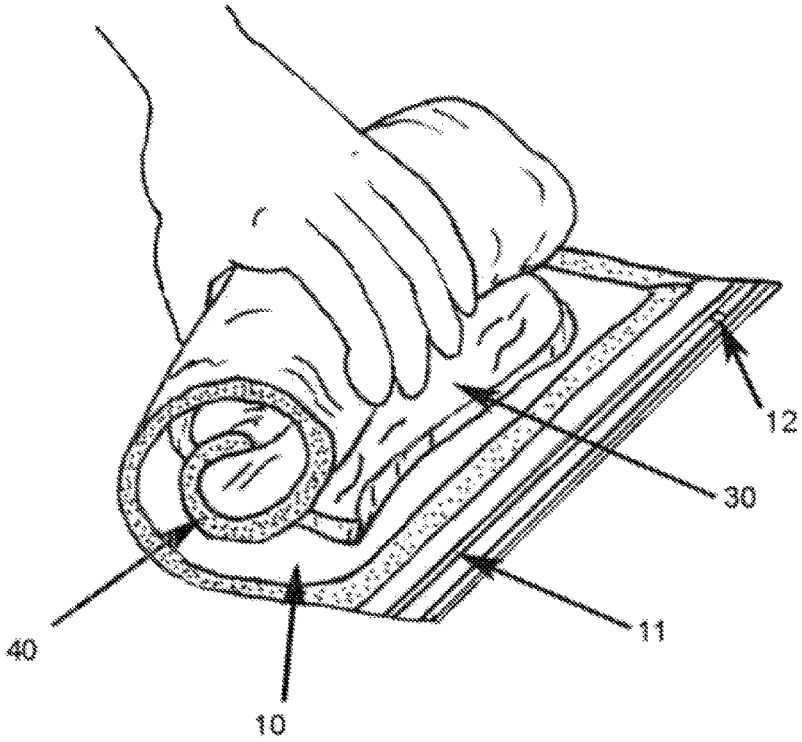
FIG. 4 is a perspective view of the polymeric bag and sponge material combination with a one-way valve demonstrating the use thereof.
Figure 5:
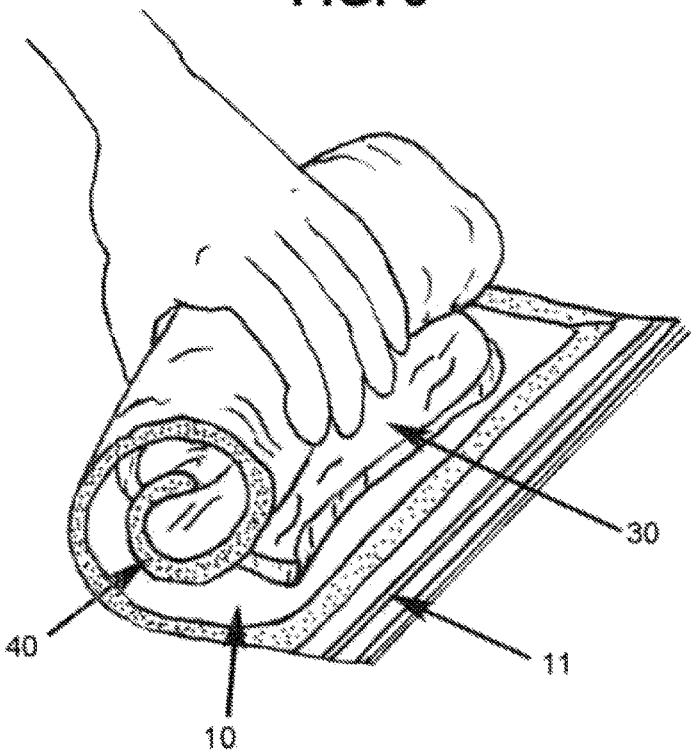
FIG. 5 is a perspective view of the polymeric bag and sponge material combination demonstrating the use thereof.
Figure 6:
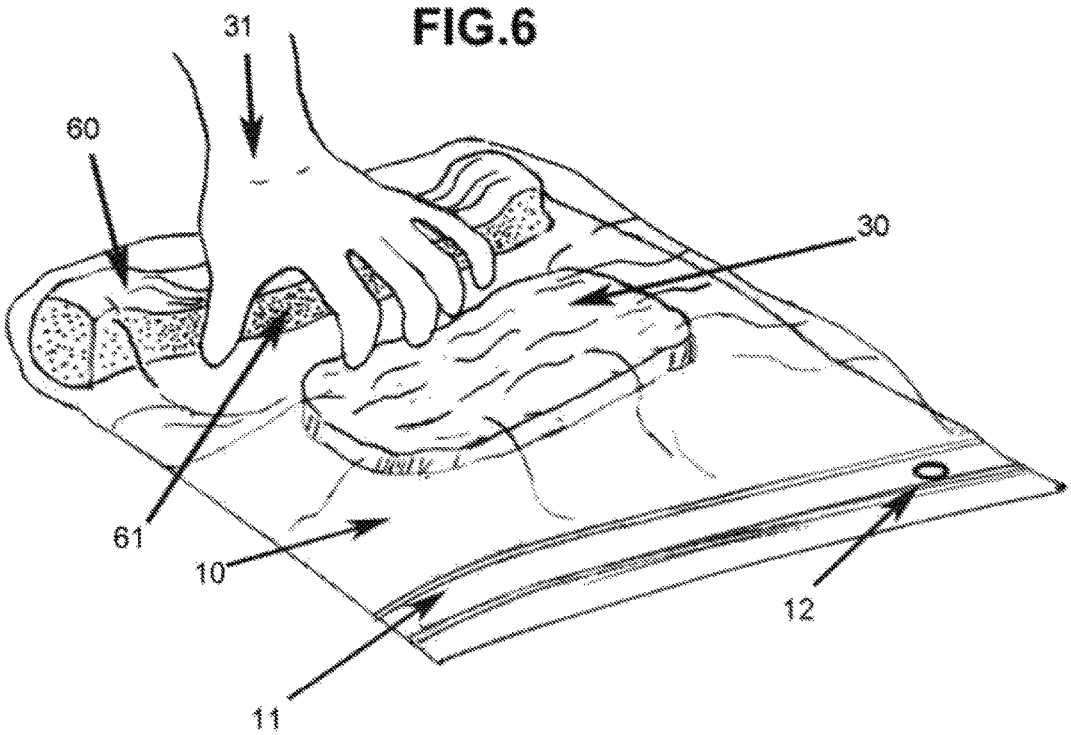
FIG. 6 is a perspective view of another embodiment of the polymeric bag and sponge material combination.
Figure 7:
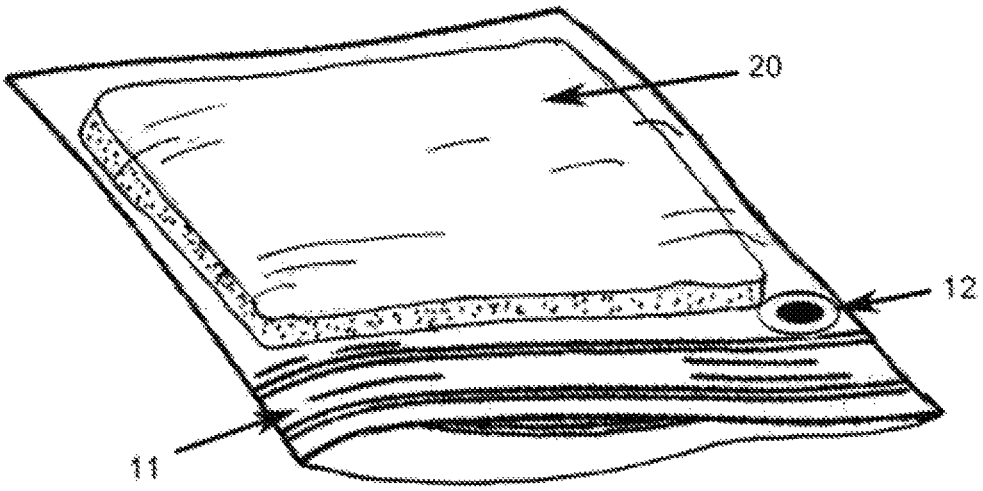
FIG. 7 is a perspective view of another embodiment of the polymeric bag and sponge material combination.

Bags as used herein shall mean any container made of a polymeric sheet material for the purpose of placing goods within. The polymeric material could also be a polyethylene terepthalate (PET) material with a metal coating for electrostatic protection. The polymeric material could also be made of a material with UV coating with a colored surface of any color for identification purposes of these bags.

Valve as used herein shall mean an opening comprising a one way orifice or flap that can be either on bag wall or bag slide zipper closure assembly or pinch rail closure system, many of which are already available, which allow removal of trapped air from inside a sealed bag to outside of bag.

Sponge as used herein shall mean any inert, compressible, resilient, expanded polymer, with either open or closed cell structure, formed in any shape so as to impart a vacuum in bag when bag is sealed after compressing sponge by rolling or compressing sponge material with contents to expel trapped gas through an opening or utilizing a one way valve system. Sponge may or may not have impenetrable skin on exposed flat surface so as to retard absorption of any fluids into sponge body but still allowing ends of sponge to pull gasses into sponge mass. Polyethylene material is one example for both bag and compressible resilient mass. The sponge may also be any other desirable polymer. The sponge may also be referred to as an expanded poly-sponge.

Getter as used herein shall mean an absorber of specific gasses or moisture, depending on getter being applied.

Desiccant as used herein shall mean any moisture removing substance depending what one is storing. For example, storing sensitive medical substances or dry goods or electronic components, one could use silica gel.

1. Best Mode of the Invention

The best mode of the present invention as contemplated by the inventor, as seen in the drawings, provides a vacuum storage bag 10 for food or other contents 30 and a resilient sponge material 20 made of an expanded polymer 40. Air may be expelled from storage bag 10 through air tight valved zipper closure combination 12, pinch rail valve closure system 11 or an adhesive sealing strip which may have a circular valve aperture 12 on bag wall or combination of these closures and valves, which are all readily available to those skilled in the art. Vacuum storage bag 10 can use any of these closure methods and any of these assemblies and will produce a vacuum in the storage bag 10 where food, dry goods or non food products 30 are now in a sealed and a pump generated vacuum inside the container.

3. How to Make the Invention

It is well known to those skilled in the art that there are many variations of bag storage systems and vacuum methods for sealing goods inside a bag and outside the presence of air. It also must be mentioned that if one prefers a permanent sealing method, one need only acquire a heat sealer without a vacuum system should the user not want to invoke the use of valved zipper closures or pinch rail valve closure systems 11. A circular aperture valve 12 on the bag wall can be utilized as a means to remove air from the storage bag 10 and the heat sealer can be used to make a, permanently bonded reliable seal that can typically be sliced open and, space permitting, may heat seal again on new surface.

The use of a myriad of available one way gas valves 12 attached to one of the sides of a bag 32 can also facilitate the expulsion of air in the bag after the storage bag 10 has been sealed with contents 30. One can compress 31 and force air out through the aperture valve 12.

The inert resilient compressible sponge member 20 or any other inert resilient compressible polymeric material may or may not span the entire bag space within the encompassing three permanently attached sides of the poly-bag 32.

Sponge can be formed to the internal wall of poly storage bag 10 as an integral part of bag wall 32 or inserted as a loose sponge sheet or mass of any shape and may also be attached by sticky back adhesive seal or heat bonded to become an integral part of bag wall 60.

It is important to note that a getter or a desiccant material can be imbedded into the resilient polymeric material for absorbing oxygen or nitrogen for use with materials that need dehydration. The material used in this application would depend whether one is evacuating and storing an edible product or not. This method could also be used to store materials that are sensitive to air or moisture, such as electronic parts, sensitive chemicals or medical products.

3. How to Use the Invention

A storage bag 10 that may be re-closeable or a one-time sealable bag which may include 3 sealed sides with an open top. The bag 10 includes a sealable method that may utilize a myriad of airtight, sealable, valved zipper slider closures or a pinch rail valve closure 11 system that are a valve and seal combination. The bag 10 may also be a bag with a one way circular aperture valve 12 as part of a bag wall. The bag 10 may use any combination of the available previously mentioned closure valve assemblies, a sealable, an adhesive seal that has a pull off barrier paper tab that is a removable strip to expose the adhesive layer prior to adhering the upper open end of bag to itself after inserting the air sensitive contents 30 to be stored in such storage bag 10. The present invention will greatly reduce the problem of freezer burn or rancidity depending on contents when storage bag 10 is evacuated and is much more economical than existing systems. This storage bag 10 is not limited to only freezer storage but can find use in refrigerator or pantry storage to protect contents from becoming rancid.

The invention claimed is:

1. A method of creating and maintaining a vacuum in a bag comprising the steps of: securing a bag, the bag having two walls, the walls of the bag having an internal wall inside of the bag, a polymeric film material makes up the walls of the bag, an inert, compressible, resilient, expanded open-cell polymeric sponge material is an integral part of an internal wall of the bag, its size determined by the dimensions of the bag's internal wall, and an airtight, sealable end of the bag that will stop migration of gases in or out of the bag; placing an article to be stored into the bag; compressing the inert, compressible, resilient, expanded open-cell polymeric sponge material that is an integral part of an internal wall of the bag; closing the airtight, sealable end of the bag to stop migration of gases in or out of the bag; and releasing compression of the sponge material when the bag is sealed thereby creating and maintaining a vacuum inside of the bag.

2. A method of creating and maintaining a vacuum in a bag according to claim 1, wherein the compressing step is accomplished by first applying pressure to the external walls of the bag to compress the compressible, resilient, expanded open-cell polymeric sponge material, then sealing the bag while maintaining compression.

3. A method of creating and maintaining a vacuum in a bag according to claim 1, wherein a vacuum is obtained by releasing external pressure after the bag is sealed, allowing the compressible, resilient, expanded open-cell polymeric sponge material to return to its original dimension, pulling residual gasses into the sponge itself and away from the stored item, thereby creating and maintaining an area of negative atmospheric pressure in the space around it within the bag.

4. A method of creating and maintaining a vacuum in a bag comprising the steps of: securing a bag, the bag having two walls, the walls of the bag having an internal wall inside the bag, a polymeric film material makes up the walls of the bag, an inert, compressible, resilient, expanded open-cell polymeric sponge material is an integral part of an internal wall of the bag, its size determined by the dimensions of the bag's internal wall, an airtight sealable end of the bag that will stop migration of gases in or out of the bag, and a one-way valve through one wall of the bag:

placing an article to be stored into the bag;

compressing the inert, compressible, resilient, expanded open-cell polymeric sponge material that is an integral part of an internal wall of the bag;

closing the airtight, sealable end of the bag to stop migration of gases in or out of the bag; and releasing compression of the sponge material when the bag is sealed, thereby creating and maintaining a vacuum inside of the bag.

5. A method of creating and maintaining a vacuum in a bag according to claim 4, wherein the compressing step is accomplished by first applying pressure to the external walls of the bag to compress the compressible, resilient expanded open-cell polymeric sponge material, then sealing the bag while maintaining compression.

6. A method of creating and maintaining a vacuum in a bag according to claim 4, wherein a vacuum is obtained by releasing external pressure after the bag is sealed, allowing the compressible, resilient expanded open-cell polymeric sponge material to return to its original dimension, pulling residual gasses into the sponge itself and away from the stored item, thereby creating and maintaining an area of negative atmospheric pressure in the space around it within the bag.

7. A method of creating and maintaining a vacuum in a bag comprising the steps of: securing a bag, the bag having two walls, the walls of the bag having an internal wall inside of the bag, a polymeric film material makes up the walls of the bag, an inert, compressible, resilient, expanded open-cell polymeric sponge material that is affixed to an internal wall of the bag, its size determined by the dimensions of the bag's internal wall, and an airtight, sealable end of the bag that will stop migration of gases in or out of the vacuum storage bag; placing an article to be stored into the bag; compressing the inert, compressible, resilient, expanded open-cell polymeric sponge material that is affixed to an internal wall of the bag; closing the airtight, sealable end of the bag to stop migration of gases in or out of the bag; and releasing compression of the sponge material when the bag is sealed, thereby creating and maintaining a vacuum inside of the bag.

8. A method of creating and maintaining a vacuum in a bag according to claim 7, wherein the compressing step is accomplished by first applying pressure to the external walls of the bag to compress the compressible, resilient expanded open-cell polymeric sponge material, then sealing the bag while maintaining compression.

9. A method of creating and maintaining a vacuum in a bag according to claim 7, wherein a vacuum is obtained by releasing external pressure after the bag is sealed, allowing the compressible, resilient expanded open-cell polymeric sponge material to return to its original dimension, pulling residual gasses into the sponge itself and away from the stored item, thereby creating and maintaining an area of negative atmospheric pressure in the space around it within the bag.

10. A method of creating and maintaining a vacuum in a bag comprising the steps of: securing a bag, the bag having two walls, the walls of the bag having an internal wall inside of the bag, a polymeric film material makes up the walls of the bag, an inert, compressible, resilient, expanded open-cell polymeric sponge material is affixed to an internal wall of the bag, its size determined by the dimensions of the bag's internal wall, an airtight, sealable end of the bag that will stop migration of gases in or out of the bag, and a one-way valve through one wall of the bag; placing an article to be stored into the bag; compressing the inert, compressible, resilient, expanded open-cell polymeric sponge material that is affixed to an internal wall of the bag; and closing the airtight, sealable end of the bag to stop migration of gases in or out of the bag; and releasing compression of the sponge material when bag is sealed, thereby creating and maintaining a vacuum inside of the bag.

11. A method of creating and maintaining a vacuum in a bag according to claim 10, wherein the compressing step is accomplished by first applying pressure to the external walls of the bag to compress the compressible, resilient expanded open-cell polymeric sponge material, then sealing the bag while maintaining compression.

12. A method of creating and maintaining a vacuum in a bag according to claim 10, wherein a vacuum is obtained by releasing external pressure after the bag is sealed, allowing the compressible, resilient expanded open-cell polymeric sponge material to return to its original dimension, pulling residual gasses into the sponge itself and away from the stored item, thereby creating and maintaining an area of negative atmospheric pressure in the space around it within the bag.

* * * * *